US006003980A

United States Patent [19]

Sheinman et al.

[11] Patent Number: 6,003,980

[45] Date of Patent: Dec. 21, 1999

[54] CONTINUOUS INK JET PRINTING APPARATUS AND METHOD INCLUDING SELF-TESTING FOR PRINTING ERRORS

[75] Inventors: Yoshua Sheinman, Raanana; Meyer Weksler, Mazkeret Batia, both of Israel

[73] Assignee: Jemtex Ink Jet Printing Ltd., Tel Aviv, Israel

[21] Appl. No.: 08/827,577

[22] Filed: Mar. 28, 1997

[51] Int. Cl.[6] ..... B41J 29/393; B41J 2/12

[52] U.S. Cl. ..... 347/78; 347/19

[58] Field of Search ..... 347/19, 78, 81, 347/82, 73, 74

[56] References Cited

U.S. PATENT DOCUMENTS

| | | | |
|---|---|---|---|
| 4,542,385 | 9/1985 | Jinnai et al. | 347/78 |
| 4,590,483 | 5/1986 | Regnault et al. . | |
| 4,907,013 | 3/1990 | Hubbard et al. | 347/19 |
| 5,189,521 | 2/1993 | Ohtsubo et al. | 358/296 |
| 5,408,255 | 4/1995 | Emerson . | |
| 5,502,474 | 3/1996 | Katerberg et al. . | |

*Primary Examiner*—N. Le
*Assistant Examiner*—Thien Tran
*Attorney, Agent, or Firm*—McDermott, Will & Emery

[57] ABSTRACT

A method and apparatus for sensing improper operation of an ink jet printer having a plurality of nozzles each emitting, towards a substrate, a series of ink drops broken-off from a continuous ink jet filament, and selectively charging and deflecting said drops according to a pattern of marks to be printed by a respective nozzle on the substrate by: controlling the plurality of nozzles to print test marks on a test strip including a plurality of marks for each nozzle produced by a series of drops from the nozzle while at different charge levels: sensing the test marks for each nozzle; analyzing the test marks for all the nozzles for proper operation of the ink jet printer; and producing an output signal indicating errors in the operation of the printer.

31 Claims, 9 Drawing Sheets

CONTINUOUS INK JET PRINTING APPARATUS AND METHOD INCLUDING SELF-TESTING FOR PRINTING ERRORS

FIELD AND BACKGROUND OF THE INVENTION

The present invention relates to ink jet printing and particularly to a method and apparatus for sensing and for correcting certain types of errors in the operation of an ink jet printer.

Continuous ink jet printers are based on stimulated formation of the ink drops from a continous ink jet filament at a rate determined by an external perturbation source. The ink drops are selectively charged and deflected according to an external data source such that ink drops emitted from the nozzle of the printing head selectively impinge on a substrate and generate a printing or marking pattern on it.

The charges carried by the drops are defined by the field to which the filament is subject at the moment of drop break-off from the jet filament. Typically, the ink is conductive, and the jet filament functions as an electrode which provides the charges necessary to charge the drops. The external charging field is typically provided by close-by electrodes in a capacitive arrangement relative to the jet filament.

Continuous ink jet printers are divided into two types of systems: binary, and multi-level. In binary systems, the drops are either charged or uncharged and accordingly either reach or do not reach the substrate at a single predetermined position. In multi-level systems, the drops can receive a large number of charge levels and accordingly can generate a large number of print positions.

The process of drop formation depends on many factors associated with the ink rhelogy (viscosity, surface tension), the ink flow conditions (jet diameter, jet velocity), and the characteristics of the perturbation (frequency and amplitude of the excitation). Typically, drop formation is a fast process, occurring in the time frame of a few microseconds. However, because of possible variations in one or more of the several factors determining the drop formation, there are possible variations in the exact timing of the drop break-off. These timing variations, which can be described by phase shifts in the period of drop break-offs, can cause incorrect charging of drops if the electrical field responsible for drop charging is turned-on or turned-off (or changed to a new level) during the drop break-off itself. Therefore it is necessary to keep the data pulse in-phase relative to the drop break-off timing, in order to obtain accurate drop charging and printing.

Previous continuous ink jet systems which contain a typical nozzle diameter of 35–70$\mu$ operate at relatively high drop generation frequencies, typically higher than 60 kilohertz. Therefore, the drop period is small, in the order of 15 microseconds, and the drop formation time corresponds to about 20% or more of the drop cycle. This indicates that phase control in continuous ink jet systems has to be very tight in order to guarantee correct operation continuously.

Many techniques for phase control have been devised. Some drops are cyclically or constantly monitored for the value of charge they carry by using sensitive electrometers. These electrometers are prone to EMI and RFI interference; and because of the need to place them very close to the stream of drops, serious maintenance problems might develop.

In multi-jet systems, the use of electrometer based phase sensing for each jet in the head becomes extremely difficult and costly. Therefore, techniques were devised to overcome phasing problems which are not based on direct sensing of drop charges, but rather which are based on the design and/or direct sensing of the excitation signal itself. However, these techniques were also found to be extremely complicated and also only partially accurate particularly with ink printers having a large number of nozzles.

Examples of known systems are described in U.S. Pat. Nos. 4,590,483, 5,408,255 and 5,502,474.

OBJECTS AND BRIEF SUMMARY OF THE PRESENT INVENTION

An object of the present invention is to provide a new method for detecting and correcting certain types of errors in the operation of a multi-nozzle ink jet printer, which method has a number of advantages in the above respects. Another object of the invention is to provide ink jet printing apparatus which permits improper operation of the printer to be detected and corrected in a convenient manner.

According to one aspect of the present invention there is provided a method of sensing improper operation of an ink jet printer having a plurality of nozzles each emitting, towards a substrate, a series of ink drops broken-off from a continuous ink jet filament, and selectively charging and deflecting the drops according to the marks to be printed by the respective nozzle on the substrate, comprising: controlling the plurality of nozzles to print test marks on a test strip including a plurality of marks for each nozzle produced by a series of drops from the nozzle while at different charge levels; sensing the test marks, preferably by an optical sensor; analyzing the test marks for proper operation of the ink jet printer; and producing an output signal indicating errors in the operation of the printer.

The invention is particularly useful in multi-level systems and is therefore described below with respect to such an application. According to further features in the described preferred embodiment, the ink drops from each nozzle are charged with multi-level charges, including: a "0" charge when the ink drop is to be received undeflected (or almost undeflected) on the substrate; a plurality of different-level charges of one sign according to the amplitude of deflection to be applied to the ink drop before received on the susbtrate; and a charge of the opposite sign when the ink drop is not to be received on the substrate.

In the described preferred embodiment, the mark produced by the "0" charge is used for detecting charging-phase errors between the charging pulses and the break-off times of the ink drops; such errors are corrected by adjusting the phase of the charging pulses. The spacing between the two marks in the pattern of test marks is used to indicate a velocity error in the velocity of the drops emitted from the respective nozzle; ink drop velocity errors are compensated by adjusting the voltage of the charge pulses.

According to another aspect of the present invention, there is provided ink jet printing apparatus comprsing: a printer head having a plurality of nozzles each emitting a series of ink drops broken-off from a continuous ink jet filament towards a susbtrate; an electrical charger for selectively charging the drops according to a pattern to be printed on the substrate; a processor for controlling the printer head and the electrical charger to cause the nozzles to emit ink drops, and the charger to charge the ink drops, according to the pattern to be printed on the substrate; the processor also controlling the plurality of nozzles to print test marks on a test strip including a plurality of marks for each nozzle produced by a series of drops from a nozzle while at different charge levels; and a sensor for sensing the test marks and for producing an output signal to the processor corresponding to the pattern test marks; the processor analyzing the output signal of the sensor to produce an output indicating errors in the operation of the printer.

As will be described more particularly below, the foregoing features of the method and apparatus of the present invention enable ink jet printers to be constructed and operated in a manner which permits many errors in the operation of the printer to be easily detected and conveniently corrected.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
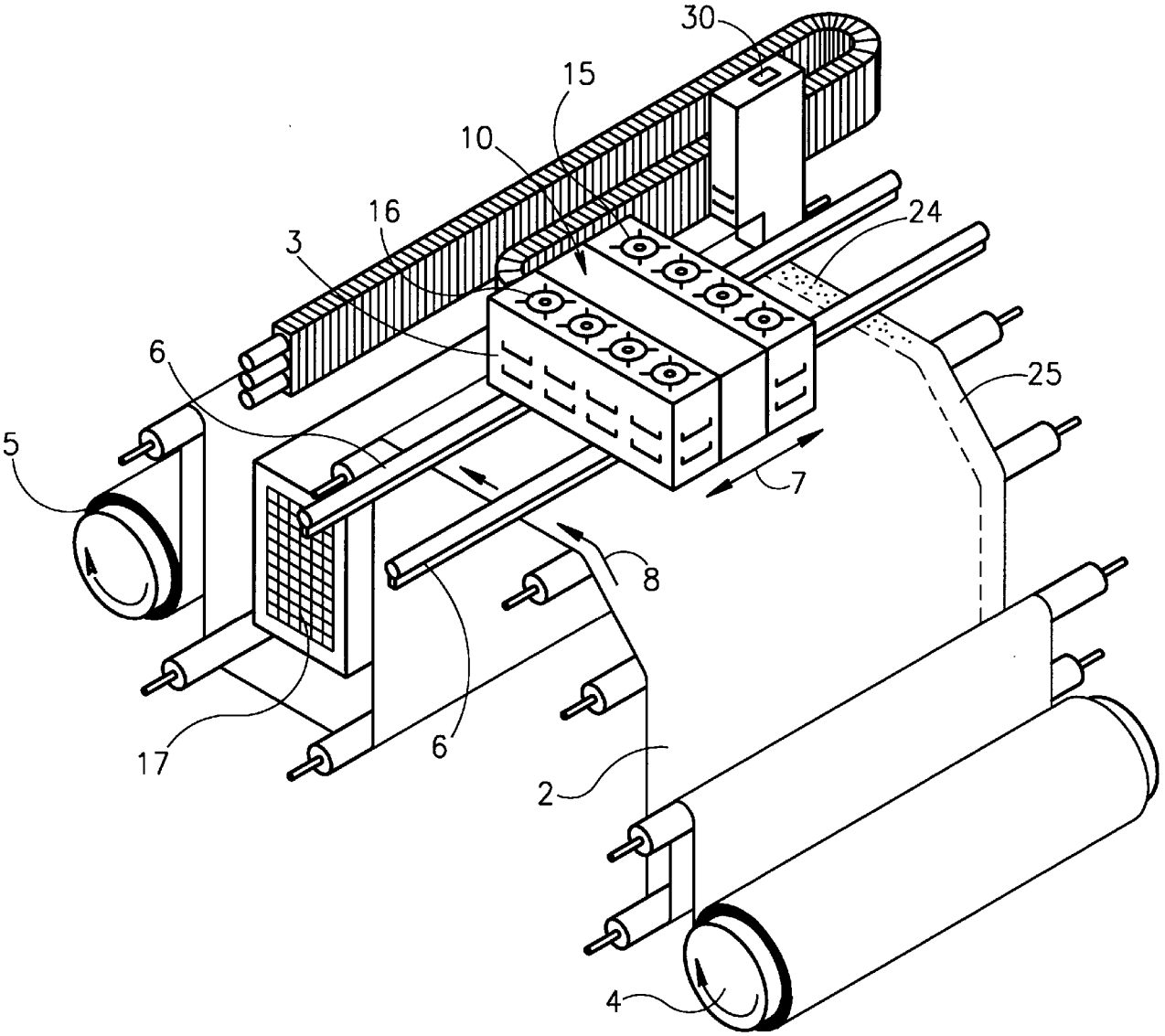
FIG. 1 shematically illustrates one form of ink jet printing apparatus constructed in accordance with the present invention.

The apparatus illustrated in FIG. 1 is an ink jet printer printing multi-color ink patterns on a substrate 2 (e.g., a paper, plastic or fabric web) fed past a print head assembly 3 from a supply roll 4 to take-up roll 5. The print head assembly 3 is continuously driven back and forth on a pair of tracks 6 extending transvesely across the substrate 2, as shown by arrow 7; whereas the substrate 2 is driven in steps in the longitudinal direction, as shown by arrows 8, between the supply roll 4 and the take-up roll 5.

Figure 2:
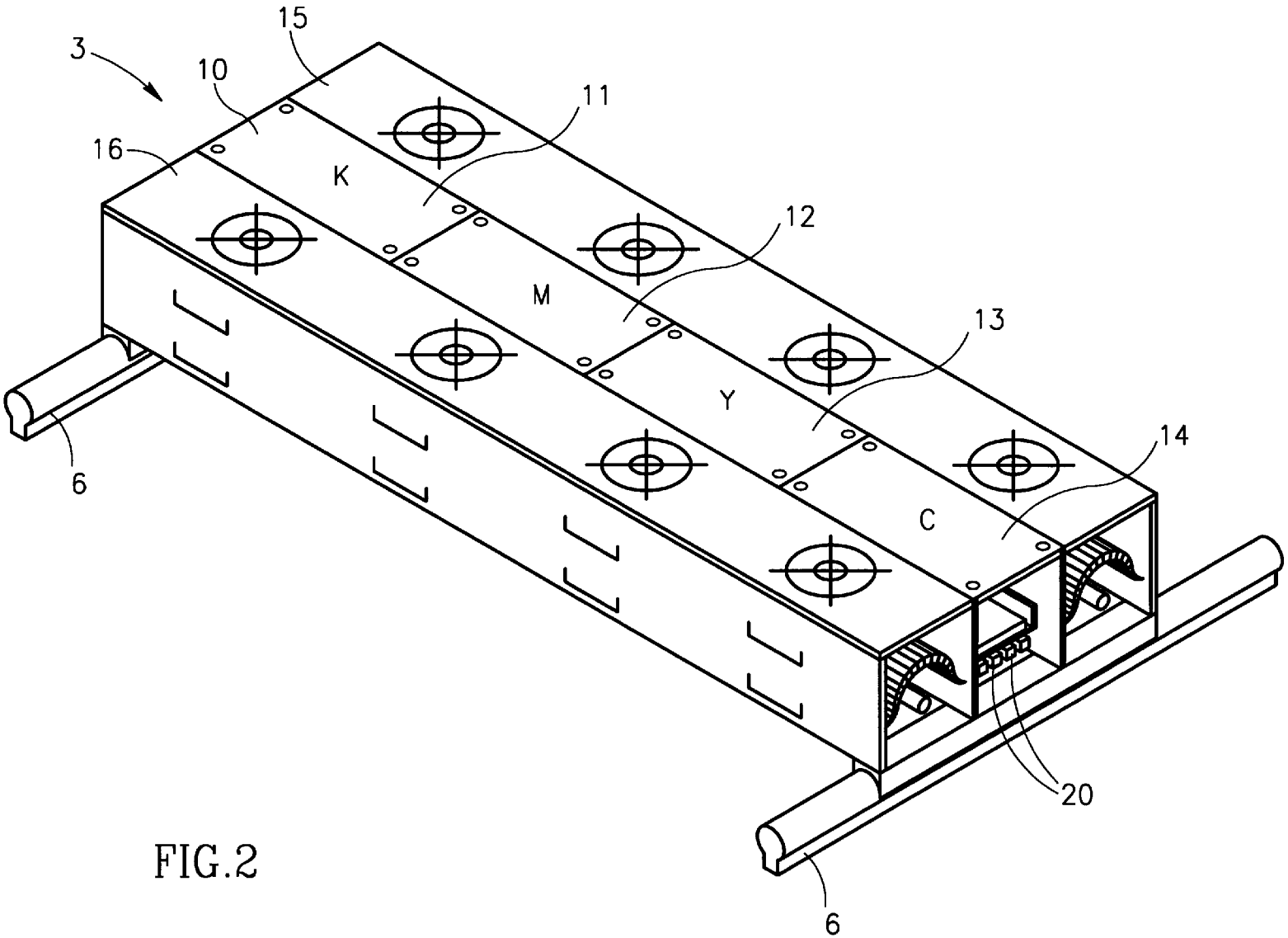
FIG. 2 more particularly illustrates the print head assembly in the apparatus of FIG. 1.

As shown particularly in FIG. 2, print assembly 3 includes a multiple-color print unit 10, constituted of four monochrome print heads, namely a black print head 11, a magenta print head 12, a yellow print head 13, and a cyan print head 14, for printing the four process colors (K M Y C). The print heads are arranged in a line extending perpendicularly to the path of movement of the print assembly 3 on tracks 6. Each print head 11–14 includes a plurality of nozzles emitting a series of ink drops towards the substrate 2.

Print head assembly 3 further includes a pair of curing units 15, 16 straddling the opposite sides of print unit 10 and effective to dry the ink applied to the substrate during both directions of movement of the print assembly 3 transversely across the substrate. Each curing unit 15, 16 may be of the ultraviolet or infrared type, according to the printing ink used. The apparatus may further include a fixed dryer unit 17 (FIG. 1) extending transversely across the substrate path of movement.

Each of the print heads 11–14 includes an array of nozzles 20 extending transversely across the path of movement of the print assembly 3, i.e., parallel to the path of movement of the substrate 2. The nozzles may be arrayed in a single vertical line or column, but preferably are arrayed in a plurality of columns (four being shown in FIG. 2) in non-overlapping staggered relationship to each other to provide a high density nozzle array. As known in ink jet printers of this type, each nozzle emits a series of ink drops towards the substrate 2 and selectively charges the drops according to the marks to be printed by the respective nozzle on the substrate.

During the actual printing, the motion of the print assembly 3 is continuous and uniform, while the substrate is kept static. When the print assembly 3 reaches its limit of travel in the transverse direction, it reverses and travels transversely across the substrate in the reverse direction. During the movement reversal time, the substrate is advanced one step to align a new transverse sector of the substrate with the print assembly.

All four monochrome heads 11–14 are operated to print all the process colors K M Y C during each transvese movement of the print assembly 3, but the substrate 2 is stepped only the length (in the arrow 8 direction, FIG. 1) of one of the print heads, i.e., one-fourth the length of all four monochrome heads. Thus, only one head (e.g., the C-head 14 in FIG. 2) overlies a new sector of the substrate during each transverse movement of the print assembly.

Figure 3:
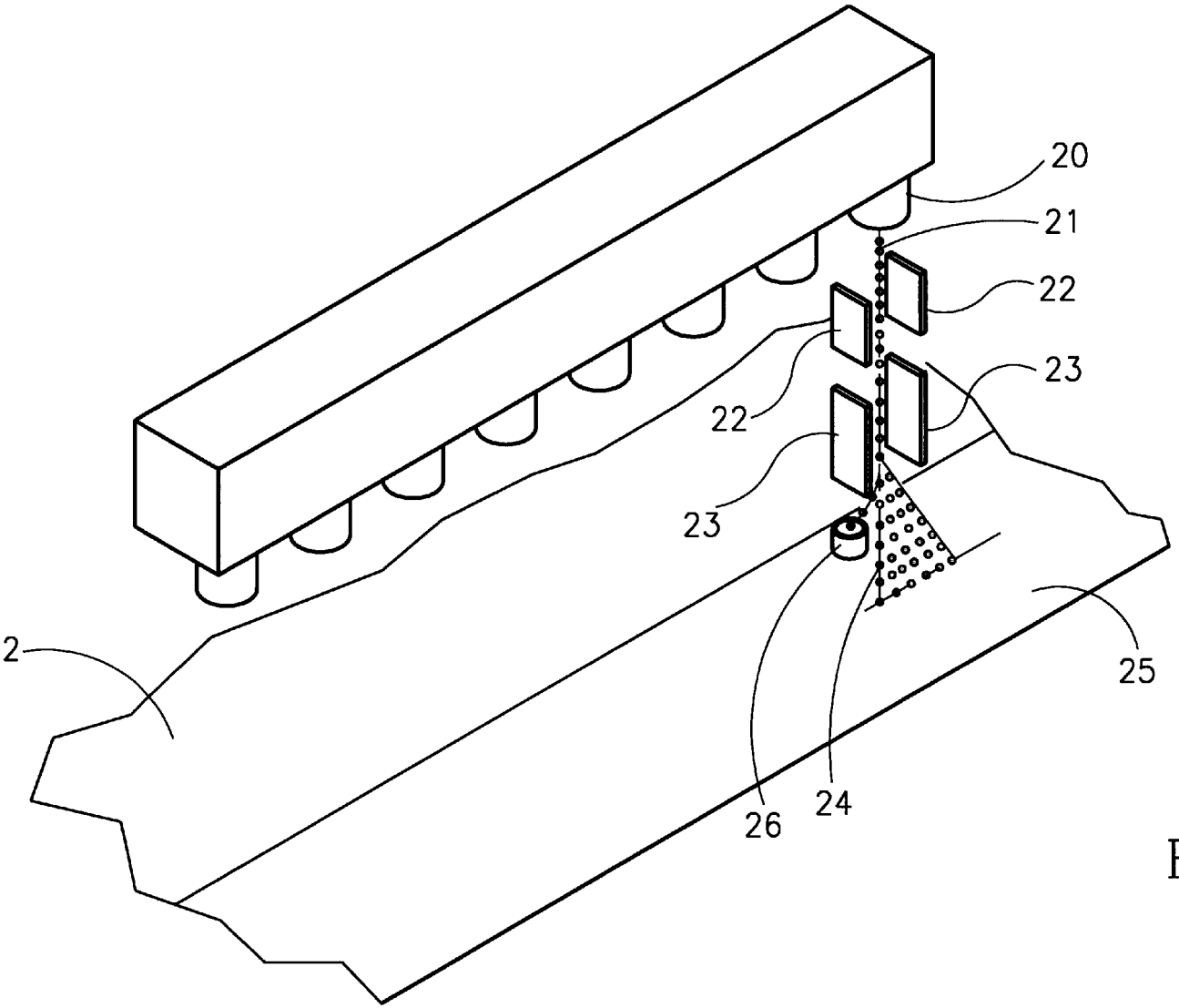
FIG. 3 shematically illustrates the multi-level printing system in the apparatus of FIGS. 1 and 2.

FIG. 3 schematically illustrates how each nozzle 20 of each of the four monochrome heads 11–14 emits a series of ink drops towards the substrate 2 and selectively charges the drops according to the marks to be printed by the respective nozzle on the substrate. Thus, as shown in FIG. 3, the ink drops 21 emitted by the respective nozzle 20 first pass between a pair of charging electrodes 22 which charge the ink drop. Each drop then passes between a pair of deflecting electrodes 23 which deflect the ink drop according to the applied charge before the ink drop impinges the susbtrate 2.

If the printer is of the binary-charge type, the drops are either charged or uncharged, and accordingly either reach or do not reach the substrate at a single predetermined position. For example, if the drop is to be printed, it is charged; and if not to be printed, it would be uncharged and would be received on a catcher, shown at 26 in FIG. 3, and not on the substrate. The binary-charge system may also be of the reverse type, wherein an uncharged drop is printed and a charge drop is not printed.

The preferred embodiment of the invention described herein is based on a multi-level charge system, wherein the drops can receive a large number of charge levels, and accordingly can generate a large number of print positions. Typical multi-level systems operate according to 8, 10, 12, or a higher number, of charge levels. For example, a print head including 120 nozzles operating according to 8 levels provides approximately 100 DPIs (dots per inch), whereas one operating at 10 levels provides approximately 120 DPIs, and one operating at 12 levels provides approximately 140 DPIs.

In the preferred embodiment of the invention described herein, the multi-level charges include: (a) a "0" charge when the ink drop is to be received, and is to be received undeflected, on a substrate; (b) a plurality of different-level charges of one sign according to the amplitude of deflection to be applied to the ink drop before received on the substrate; and (c) a charge of the opposite sign when the ink drop is not to be received on the substrate, but rather is to be received on the catcher.

According to the present invention, the nozzles 20 of each of the print heads 11–14 are controlled to print a pattern of test marks 24 on a tested strip 25 on one side of the substrate 2. These test marks are printed at the end of the respective transverse path of the print head, either immediately before the deceleration starts for the reverse path, or after the acceleration in the reverse path has been completed, so that the print head motion is uniform during the printing of the test pattern 24.

Figure 4:
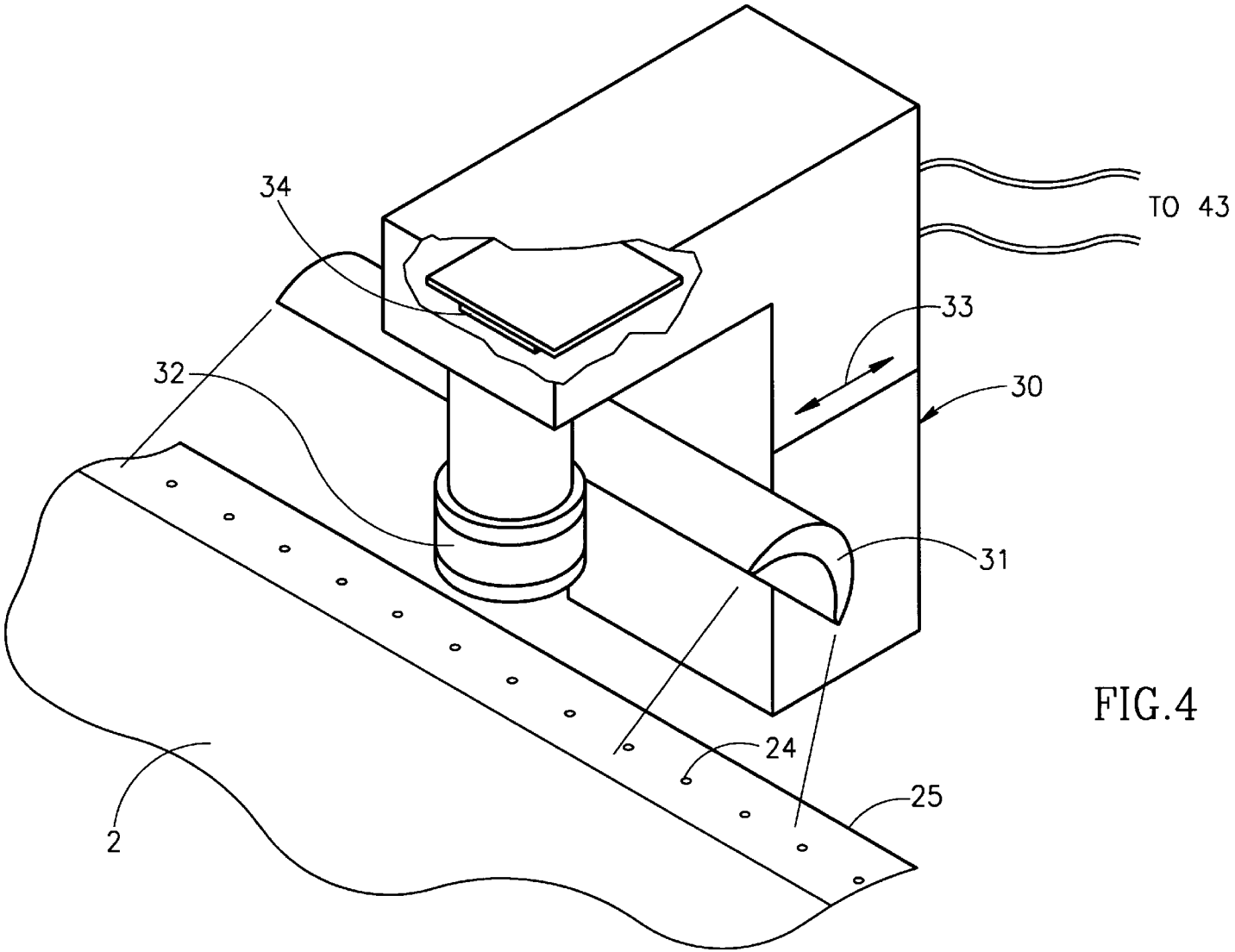
FIG. 4 is a three-dimensional view more particularly illustrating the optical sensor device in the apparatus of FIG. 1.

As shown in FIG. 4, the apparatus further includes a sensor 30 for sensing the pattern of test marks 24 on the test strip 25. Preferably, sensor 30 is an optical sensor of the CCD two-dimensional image sensing type fixedly aligned over test strip 25 of the substrate 2. As shown in FIG. 4, optical sensor 30 includes a light source 31 for illuminating test strip 25, and a lens system 32 for focussing the light reflected from the test strip 25 onto the CCD cells 34 of the sensor 30. While the sensor is fixed with respect to the printer, it would preferably be adjustable both horizontally and vertically to allow optimum alignment of the CCD cells with the test strip 25 of the substrate.

The pattern of test marks 24 on the substrate test strip 25, as sensed by the CCD sensor 34, is analyzed, e.g., with respect to a stored reference pattern representing proper operation of each of the print heads 11–14 of the apparatus, such that any discrepancies between the sensed test pattern and the reference pattern indicate improper operation of the printer. As will be described below, these discrepancies between the two patterns can be used for identifying the printing error, and for providing appropriate feedback control signals to the system controller 43 (FIG. 7) for correcting these errors.

More than one sensor can be mounted side-by-side in order to obtain a larger field of view without increasing the sensor height, or in order to obtain higher exposure resolution, i.e., more CCD cells per specific feature. The sensor is able to detect all colors, as a dynamic threshold tuning can be used. The gathered information is mainly the edges of the dots, and therefore it is easy to obtain good signals from the CCD sensor even with the limited dynamic range of such sensors since a dot can be defined by a minimal number (e.g., 5) of CCD cells.

Preferably, each dot on the test strip 25 is sensed by several CCD cells in the sensor unit 30. Calculation of the location of the dot centers provides useful information indicating the presence, type and location of any occurring printing errors.

One type of commonly-occurring printing error is incorrect phasing of the charging pulse with the break-off time of the ink drop as it passes between the charging electrodes 22 so that the ink drop is not properly deflected onto the substrate. Another type of error is an incorrect velocity of the ink drops 21, so that the ink drop is not deflected to its proper position of impingement on the subtrate 2. The above-described multi-level charges applied to the ink drops for printing purposes may also be used for sensing both types of errors, as follows.

Figure 5:
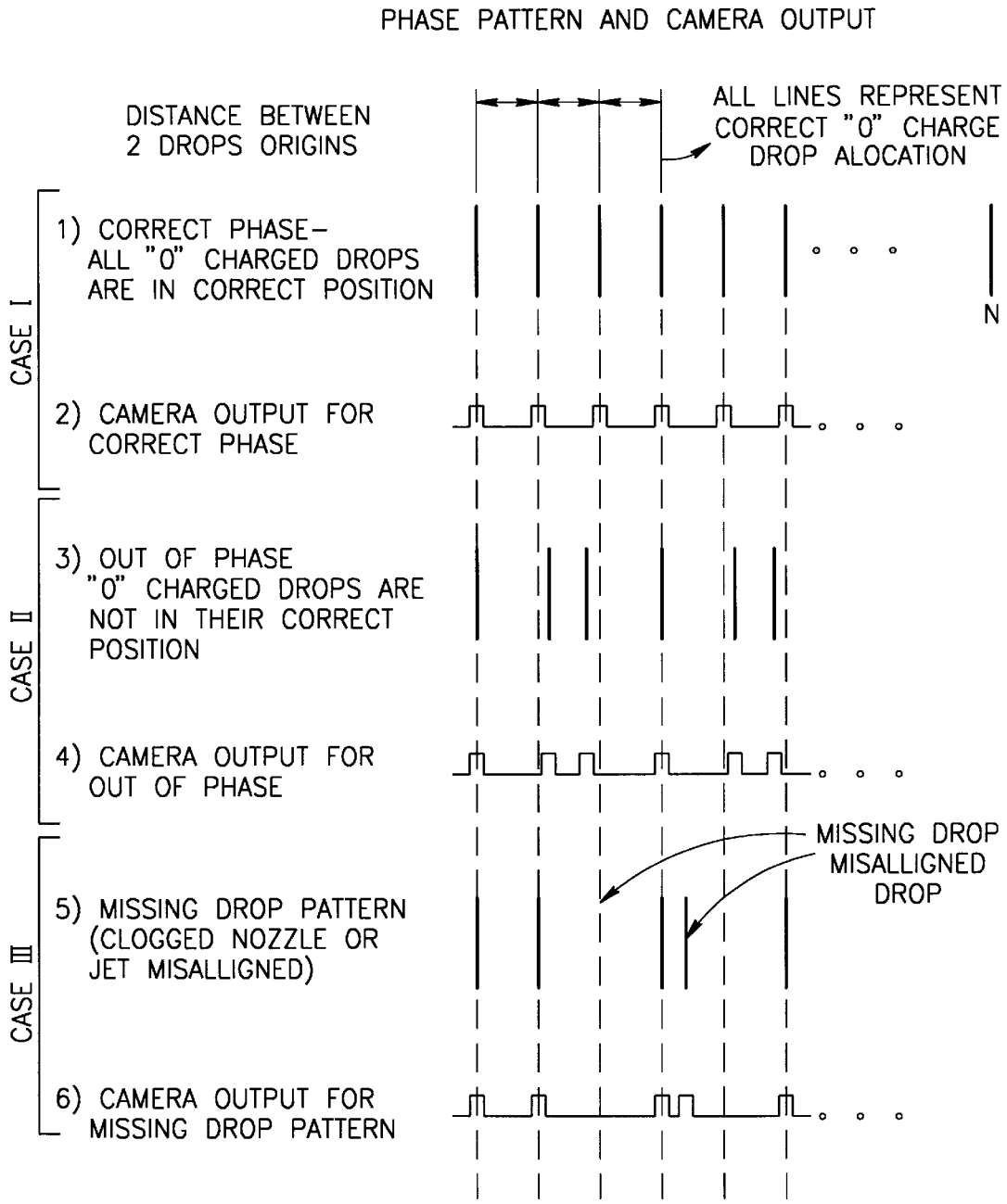
FIGS. 5 and 6 are diagrams helpful in explaining the manner of detecting phase and velocity errors, respectively, in accordance with the invention.

The "0" charge, which is applied during the printing phase to the ink drops to be received undeflected onto the substrate, will also indicate, during the test cycle, whether the charging pulses are correctly phased with the break-off times of the drop emitted from the respective nozzle. Thus, the absence of a test mark produced by a nozzle when a "0" charge is applied indicates that the charging pulses for the respective nozzle are incorrectly phased with the ink drop break-off times in the respective nozzle. This is shown particularly in FIG. 5, wherein it will be seen that when the charging pulses for the nozzles are correctly phased with respect to ink drop break-off times, a mark 24 will be printed in its proper place on the test strip 25 for each "0" charge pulse of each nozzle, and will be sensed by the CCD; whereas if there is an incorrect phasing between the charging pulses and the ink break-off times for the respective nozzle, the mark for the "0" charge will be misplaced, and therefore the output of the CCD will indicate this incorrect phasing. Such an incorrect phasing may be corrected by adjusting the phase of the charging pulses appied to the electrodes 22 in the respective nozzle 20. A missing mark for a nozzle indicates the nozzle is clogged or grossly misdirected.

Although it would be theoretically sufficient for each nozzle to print (or not print) a single dot in the test strip 25, preferably the nozzles are controlled to print marks constituted of a series of dots. The result is a bar code, rather than a dot code, which decreases the alignment problems between the optical sensor 30 and the marks 24 on the test strip 25 of the substrate. However, since the CCD cells are of smaller size than the dots, a dot will also appear as a "bar" to the CCD cells.

Figure 6:
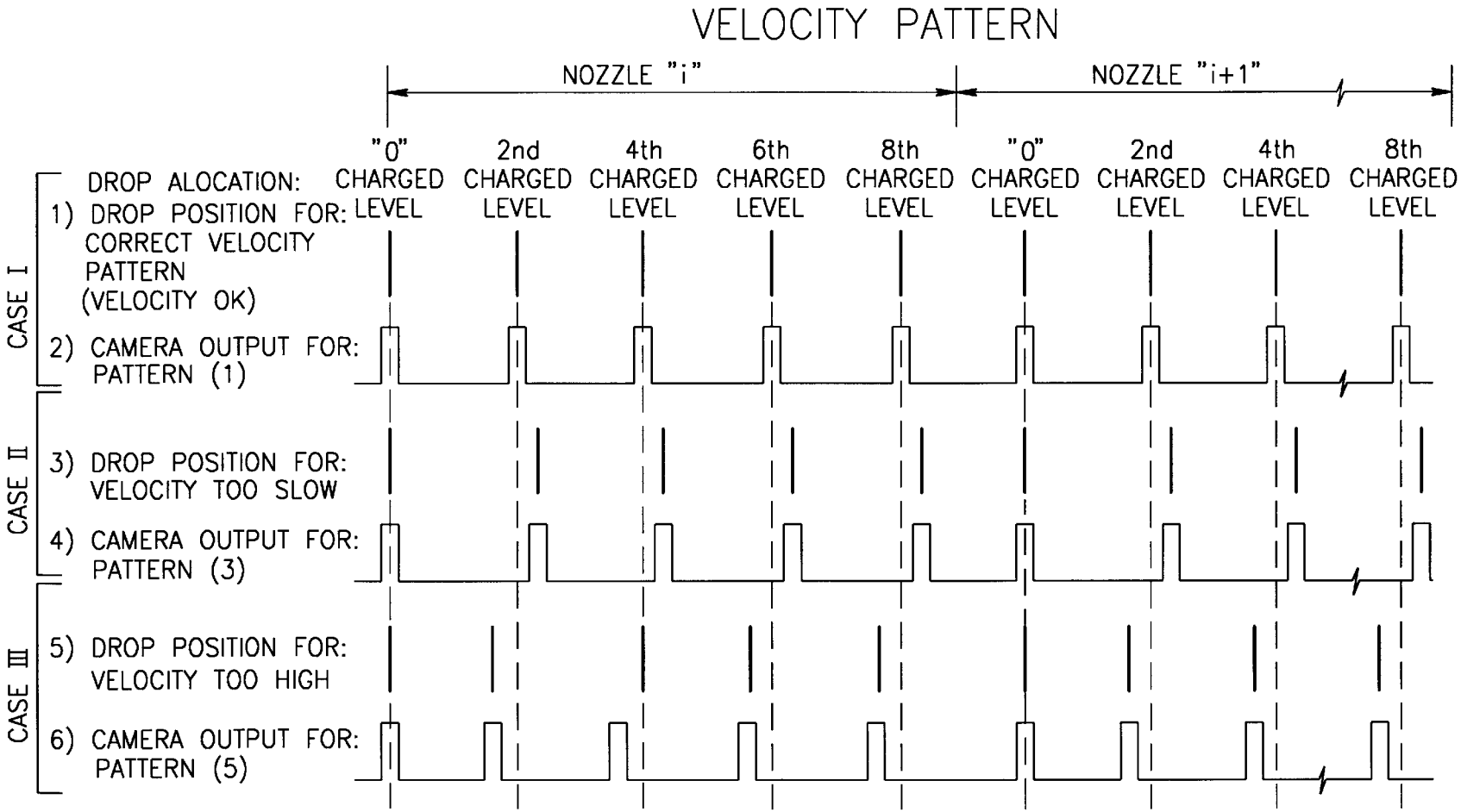

The errors caused by the incorrect velocity of the ink drops, as they pass between the deflecting electrodes 23, are indicated in FIG. 6. They are detected by the plurality of different-level charges of one sign applied to the deflecting electrodes according to the amplitude of deflection to be applied to the ink drops during the printing cycles. Thus, by measuring the spacing between the bars in the bar pattern produced on the test strip 25, and comparing those spacing with a reference pattern or reference information representing proper operation of the printer, any discrepancies between the spacings in the two patterns will indicate improper deflection of the ink drops, and thereby incorrect velocity of the drops passing between the deflector plates 23.

Jet speed errors may be produced by many different factors, such as those associated with the ink rhelogy (viscosity, surface tension) and the ink flow conditions (jet diameter, jet flow rate). In the preferred embodiment of the invention described below, such errors are corrected by changing the charging voltage applied to the ink drops, since the amount of deflection to be experienced by the ink drops before impinging the susbtrate depends on the ink jet speed (second power), and the voltage applied by the deflector plates.

As indicated earlier, the multi-level charges also include a charge of the opposite sign (from that of the multi-level charges) when the ink drop is not to be received on the substrate.

Figure 7:
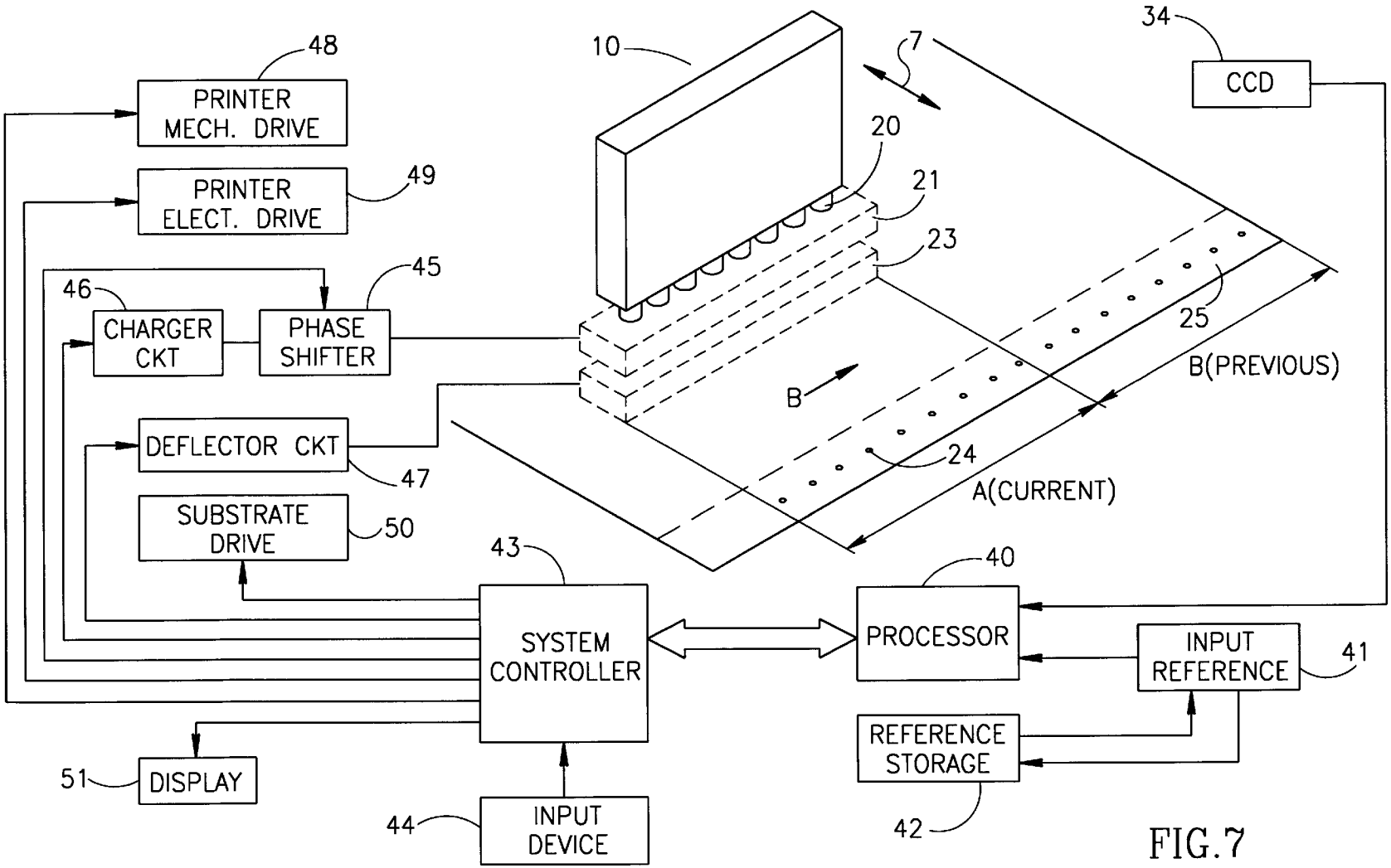
FIG. 7 is a block diagram schematically illustrating one form of control system for controlling the printing apparatus of FIG. 1.

FIG. 7 schematically illustrates the overall control system of the apparatus. Thus, it includes a processor 40 which receives the pattern of test marks on the test strip 25 as sensed by the CCD sensor 30, and compares it with the reference pattern as inputted by an input device 41 and as stored in its memory 42. The foregoing deviations between the two patterns are outputted to the system controller 43 having an input device 44.

Thus, printing errors resulting from incorrect phasing between the charging pulses applied to the ink drops from a nozzle and the ink drop break-off times, as determined in processor 40, are corrected by the system controller 43 by controlling a phase-change circuit 45 for the respective nozzle, between the charging circuit 46 and the charging electrodes 22 for the respective nozzle. Printing errors resulting from an incorrect speed in the ink drops emitted by the nozzles are corrected by the system controller 43 by adjusting the voltage applied to the drops by the charging circuit 46 for the respective nozzle.

System controller 43 further controls the printer mechanical drive 48, the printer electrical drive 49, and the substrate mechanical drive 50. Preferably, it also controls a display 51 to enable monitoring the overall operation of the apparatus.

OPERATION

Figure 8A:
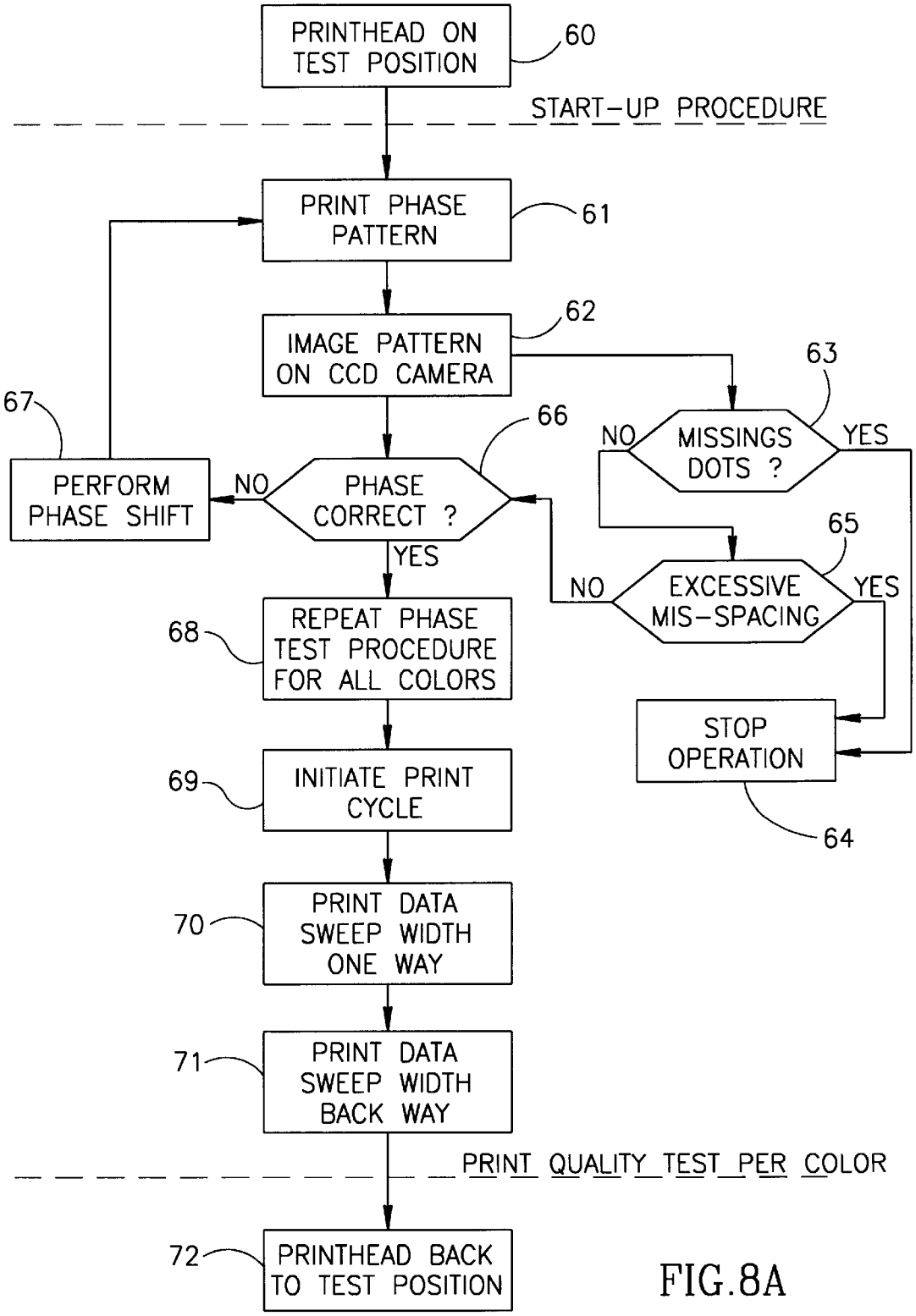
FIGS. 8*a* and 8*b*, taken together, represent a flow chart describing one manner of operating the system of FIG. 5.
Figure 8B:
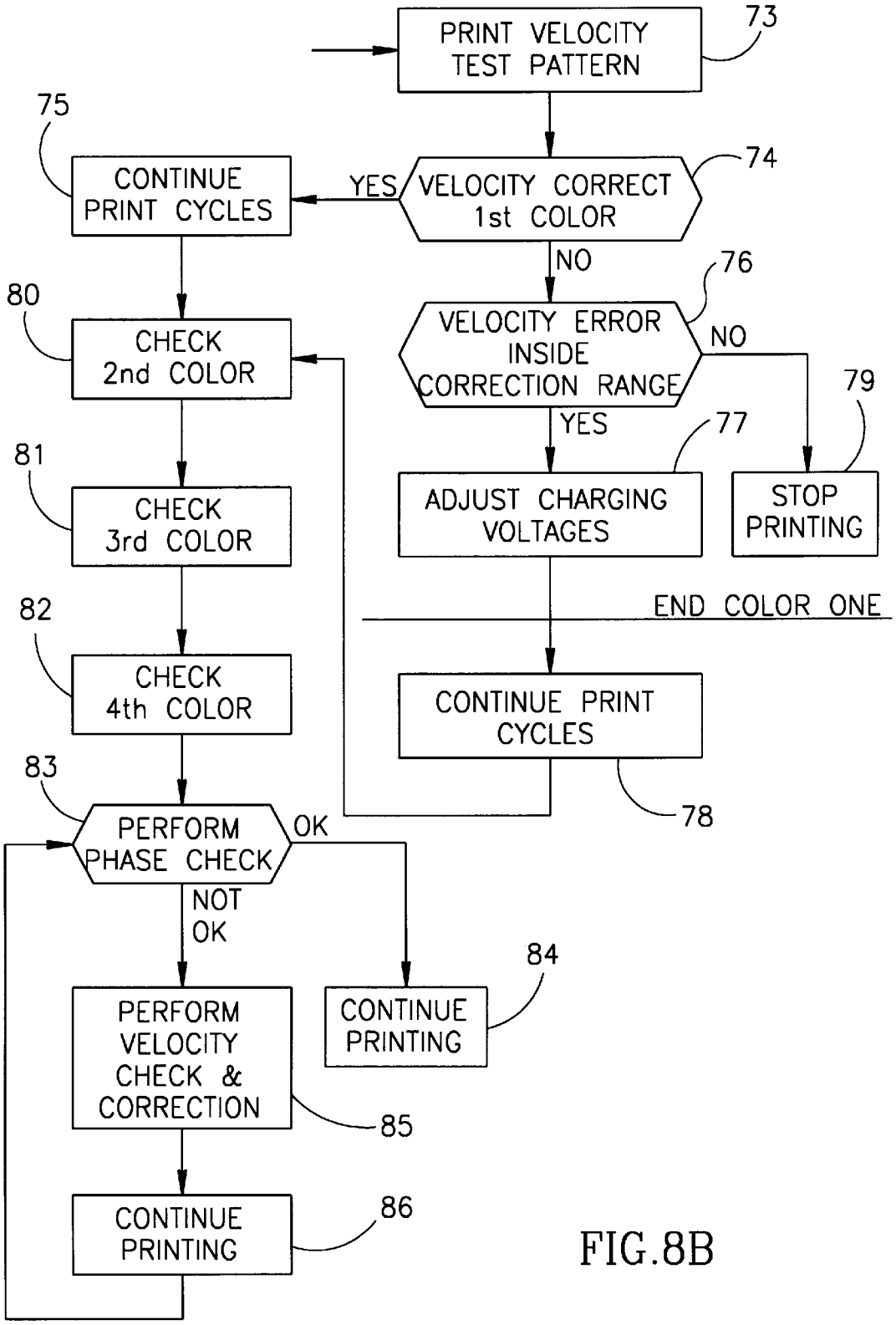

A preferred manner of operating the described apparatus is shown in the flow chart of FIGS. 8A and 8B.

With the print head assembly 3 in test position, i.e., with its nozzles aligned with test strip 25 of the substrate 2 (block 60), the nozzles are energized to produce a print phase pattern (block 61), namely a drop of ink emitted from each of the nozzles and receiving a "0" charge. The test marks so produced on test strip 25 are sensed by CCD sensor 30 (block 62), and the information is fed to processor 40. The processor analyzes this information, e.g., from a look-up table (LUT) corresponding to a reference pattern, for the following deviations from the reference pattern:

(a) a missing dot (block 63) which indicates a serious malfunction, such as a clogged nozzle or a non-aligned nozzle, and therefore serves to terminate the operation of the printer (64);

(b) an excessively-large deviation of spacing between the drops, i.e., one considerably above an allowed limit (block 65); this is also considered to be a major malfunction and serves to terminate the operation of the printer (block 64);

(c) a minor deviation in the spacing between drops, which indicates an error in the charging phase of the respective nozzle (block 66). This is corrected by controlling phase shifter 45 (FIG. 7) for the respective nozzle to shift the phase (timing) of the charging pulse in an arbitrary direction by a time (Tc) which is equal to or greater than the charging time (block 67). The pattern is again printed, and if the result is still not correct, the phase is shifted by 2Tc in the other direction, etc., until the pattern is correct.

The foregoing phase test procedure is repeated for all four monochrome heads (block 68).

A print cycle is then initiated (block 69), during which the print head assembly 3 is moved transversely of the substrate 2 along track 6 in one direction (block 70), and then in the opposite direction (block 71).

With the print head assembly 3 back in the test postion, aligned with the test strip 25 (block 72), a multi-level test pattern is printed from all the nozzles of one monochrome head 11–14 on the test strip 25. That is, each nozzle is controlled to print a raster of at least two (e.g., six) drops, one of which is a "0" charge drop, and the others are drops charged with different voltages according to the multi-level system used. For example, FIG. 6 illustrates an eight-level system, in which the velocity pattern applied to each nozzle includes a "0" charge, a second-level charge, a fourth-level charge, a sixth-level charge, and an eighth-level charge.

After this velocity test pattern has been printed from one monochrome head (block 74), the test marks are analyzed for ink velocity errors.

In a multiple-nozzle system, one way to control the ink jet velocity is via the inlet pressure and viscosity, in which case the inlet pressure and ink viscosity are sensed, compared to pre-prepared data, such as data stored in a look-up table relating to pressure, speed, viscosity, pump speed, etc., and controlled according to the data in the look-up table. Although this is a common correction for the entire number of jets, the specific jet velocity will always have some uncertainty factors which will not be able to be corrected through this type of control, because of the tolerances in the nozzle manufacturing, etc.

On the other hand, detecting and correcting for ink velocity errors is quite important as the deflection of ink drops is related to the square of the speed. In the apparatus of the present invention, such velocity errors inside a permissible correction range are corrected by changing the charging voltage applied to the ink drops for the entire raster.

Speed errors (SE) are defined as:

$$SE=(Pi,\ real,Po,real)-(Pi,\ data-Po,data)$$

where:

Pi,data—the desired location of the "i" drop in the raster

Po,real—the real location of the "i" drop in the raster

Po,data—the desired loction of the "0" charged drop in the raster

Po,real—the real location of the "0" charged drop in the raster

The speed errors are corrected by controlling the charging circuit (46, FIG. 7) for the respective nozzle according to a voltage adjustment determined through a look-up table stored in processor 40.

Before such speed errors are corrected, however, the processor checks to see whether the error is within a permissible correction range (block 76). If so, it adjusts the charging voltages (block 77) and continues the print cycle (block 78); but if not, it terminates printing (block 79).

The foregoing procedure for testing one monochrome head is repated for the other three monochrome heads (blocks 80, 81, 82).

At periodic intervals, the above-described phase check and the above-described velocity check may be repeated and corrected to continue printing (blocks 83–86).

For small length test strips, a single CCD camera 30 could be used to sense the whole strip length of four colors. For longer test strip lengths, four CCD cameras could be used, one for each color, to simultaneously control the performance of each color head. In the described preferred embodiment, the colors are sequentially test printed and sensed. The cycle time between a first color sensing and a second color sensing corresponds to a full back-and-forth print cycle. Thus, the time between successive sensing of a same color is four back-and-forth print cycles.

For example, the print head assembly may move at uniform speed of 0.8 m/s during printing, and may spend one second during each direction reversion. For a typical print width of 1.6 m, the color-to-color cycle time would be four seconds, and the successive sensing period for a single colour would be 16 seconds. In systems where the combination of system and ink characteristics requires phase correction more frequently than in this example, more than one camera can be used to reduce the sensing period.

The above-described technique is especially suitable for a multi-jet system including a high-viscosity low-speed jet, and a relatively low frequency of drop generation, as described for example in patent application Ser. No. 08/734,299, filed Oct. 21, 1996, assigned to the same assignee as the present application, the entire content of which is incorporated herein by reference. In such a system, the drop cycles are considerably longer (typically above 35 microseconds), and the drop formation time corresponds to less than 10% of the cycle. Therefore, it takes longer for the system to drift or swing out of phase, and it is possible to monitor the actual printed pattern at longer periods ranging from a few seconds to a few tens of seconds.

Non-colored inks (e.g., varnish) can be easily sensed using the near IR range (around 800 nm). Contrast problems may occur on bright white media, in which case a pre-print line could be printed before the varnish line is applied. This should not be a problem as the varnish is always applied after primary printing. If color toning is to be used in the printing process, e.g., by diluting the ink, etc., the same sensor can also be used for quantifying color coordinates of the basic colors and to send the information to the main control. Thus, inline correction can be made to assure color repeatability and quality. In this case, the line CCD sensor and the illuminatation must be carefully selected, or four different sensors can be mounted, one for each color range.

While the invention has been described with respect to one preferred embodiment, it will be appreciated that this is set forth merely for purposes of example, and that many other variations, modifications and applications of the invention may be made.

We claim:

1. A method of sensing improper operation of an ink jet printer having a plurality of nozzles each emitting, towards a substrate, a series of ink drops broken-off from a continuous ink jet filament, and selectively charging and deflecting said drops awarding to a pattern of marks to be printed by a respective nozzle on the substrate, comprising the following steps:

controlling said plurality of nozzles to print test marks on a test strip including a plurality of marks for each nozzle produced by a series of drops from the nozzle while at different charge levels:

sensing said test marks for each nozzle;

analyzing said test marks for all the nozzles for proper operation of the ink jet printer;

and producing an output signal indicating errors in operation of the printer.

2. The method according to claim 1, wherein said test marks on the test strip of the substrate are optically sensed by an optical two-dimensional image sensor.

3. The method according to claim 1, wherein said test marks further include a mark for each nozzle produced on the substrate when ink drops emitted from the nozzles are charged with pulses which are correctly phased with break-off times of the drops from the continuous ink jet filament such that upon an absence or misplacement of a mark, said output signal indicates an error in timing of the charging pulses with the drop break-off times for the respective nozzle.

4. The method according to claim 3, wherein an ink drop is charged with a "0" charge when the drop is to be printed on the substrate and with a non-"0" charge when the drop is not to be printed but rather is to be deflected to a gutter, such that a missing or misplaced mark in the test pattern indicates the respective nozzle was improperly charged with a non-"0" charge, rather than with a "0" charge, at the break-off time of the drop.

5. The method according to claim 3, wherein said output singal controls a phase shifter for correcting the phase of the charging pulses with respect to the drop break-off times in the respective nozzle.

6. The method according to claim 1, wherein said printed test marks includes at least two marks produced by each nozzle to have a predetermined spacing between said two marks for proper operation of the printer such that a deviation in said spacing indicates a velocity error in the velocity of the drops emitted from the respective nozzle.

7. The method according to claim 6, wherein said velocity error in said output controls the voltage of a charging circuit charging the drops to correct said velocity error in the respective nozzle.

8. The method according to claim 1, wherein:

said printed test marks include at least two marks for each nozzle;

one of said marks being produced on the substrate when the ink drops are properly emitted therefrom and are charged with pulses which are correctly phased with the break-off times of the drops such that:

an absence of said one mark for a nozzle indicates the respective nozzle is blocked or misaligned;

a misplacement of said one mark for a nozzle indicates an error in the timing of the charging pulses with respect to the drop-off break times for the respective nozzle; and a deviation in the spacing between said two marks in the test marks for a nozzle indicates a velocity error in the velocity of the drops emitted from the respective nozzle.

9. The method according to claim 1, wherein the ink drops emitted from each nozzle are charged with multi-level charges, including:

a "0" charge when the ink drop is to be received undeflected on the substrate;

a plurality of different-level charges of one sign according to the amplitude of deflection to be applied to the ink drop before received on the substrate; and a charge of the opposite sign when the ink drop is not to be received on the substrate.

10. The method according to claim 9, wherein the mark produced by the "0" charge is used for detecting errors between the charging pulses and the break-off times of the ink drops.

11. The method according to claim 10, wherein said charging-phase error in said output controls a phase shifter for correcting the phase of the charging pulses with respect to the drop break-off times in the respective nozzle.

12. The method according to claim 9, wherein at least some of the different level charges of said one sign are used for sensing velocity errors in the ink drops emitted by the respective nozzle.

13. The method according to claim 12, wherein, upon the sensing of a velocity error in the ink drops, the charge voltage is adjusted to correct for said velocity error.

14. The method according to claim 12, wherein said correct phasing of the charging pulses with respect to the drop break-off times is checked and corrected before checking the pattern of test marks for velocity errors in the ink drops emitted from the respective nozzle.

15. Ink jet printing apparatus, comprising:

a printer head having a plurality of nozzles each emitting a series of ink drops broken-off from a continuous ink jet filament towards a substrate;

an electrical charger and deflector for selectively charging and deflecting said drops according to a pattern of marks to be printed on the substrate;

a processor for controlling said printer head and said electrical charger to cause the nozzle to emit ink drops, and the charger to charge the ink drops, according to the pattern to be printed on the substrate;

said processor also controlling said plurality of nozzles to print test marks on a test strip including a plurality of marks for each nozzle produced by a series of drops from the nozzle while at different charge levels;

and a sensor for sensing said test marks and for producing an output signal to said processor corresponding to said test marks;

said processor analyzing said output signal of said sensor to produce an output indicating errors in the operation of the printer.

16. The apparatus according to claim 15, wherein said sensor is an optical two-dimensional image sensor.

17. The apparatus according to claim 16, wherein said processor controls said printer head and electrical charger to produce test marks which include a mark for each nozzle produced on the substrate when ink drops emitted from the nozzle are charged with pulses which are correctly phased with break-off times of the drops from the continuous ink jet filament such that upon an absence or misplacement of a mark, said output signal indicates an error in timing of the charging pulse with the drop break-off times for the respective nozzle.

18. The apparatus according to claim 17, wherein said processor controls said electrical charger to charge said ink drops with a "0" charge when the drop is to be printed on the substrate and with a non-"0" charge when the drop is not to be printed but rather is to be deflected to a gutter, such that a missing or misplaced mark in the test pattern indicates the respective nozzle was improperly charged with a non-"0" charge, rather than with a "0" charge, at the break-off time of the drop.

19. The apparatus according to claim 17, wherein said output signal controls a phase shifter for correcting the phase of the charging pulses with respect to the drop break-off times in the respective nozzle.

20. The apparatus according to claim 15, wherein said processor controls said printer head and said electrical charger to produce a printed pattern of test marks which includes at least two marks for each nozzle having a predetermined spacing between said two marks for proper operation of the printer such that a deviation in said spacing indicates a velocity error in the velocity of the drops emitted from the respective nozzle.

21. The apparatus according to claim 20, wherein said velocity error in said output controls the voltage of a charging circuit charging the drops to correct said velocity error in the respective nozzle.

22. The apparatus according to claim 15, wherein said processor controls said printer head and said electrical charger to produce a printed pattern of test marks which includes at least two marks for each nozzle;

one of said marks being produced on the substrate when the ink drops are properly emitted therefrom and are charged with pulses which are correctly phased with the break-off times of the drops such that:

an absence of said one mark for a nozzle indicates the respective nozzle is blocked or misaligned;

a misplacement of said one mark for a nozzle indicates an error in the timing of the charging pulses with respect to the drop break-off times for the respective nozzle; and a deviation in the spacing between the two marks in the pattern of test marks for a mark indicating a velocity error in the velocity of the drops emitted from the respective nozzle.

23. The apparatus according to claim 15, wherein said electrical charger charges the ink drops from each nozzle with multiple-level charges including:

a "0" charge when the ink drop is to be received undeflected on the substrate;

a plurality of different-level charges of one sign according to the amplitude of deflection to be applied to the ink drop before received on the substrate; and a charge of the opposite sign when the ink drop is not to be received on the substrate.

24. The apparatus according to claim 23, wherein said processor utilizes the output signal of said sensor corresponding to the mark produced by the "0" charge for sensing phase-charging errors between the charging pulses and the drop break-off times in the respective nozzle.

25. The apparatus according to claim 24, wherein said processor controls a phase shifter to correct the sensed phase-changing errors for the respective nozzle.

26. The apparatus according to claim 25, wherein said processor utilizes at least some of the different level charges of said one sign for sensing velocity errors in the velocity of the ink drops emitted by the respective nozzle.

27. The apparatus according to claim 26, wherein said processor, upon the detection of a velocity error in the velocity of the ink drops, changes the charging voltage for the respective nozzle to correct for said velocity error.

28. The apparatus according to claim 25, wherein siad processor checks for proper phasing of the charging pulses with respect to the drop break-off times of the respective nozzle, corrects any detected errors, and then analyzes the pattern of test marks for velocity errors in the velocity of the ink drops emitted by the respective nozzle.

29. The apparatus ccording to claim 15, wherein said apparatus further comprises:

a printer head drive for driving said printer head through a path of movement extending transvesely across said substrate, said nozzles being arranged in a linear array extending perpendicularly to said path of movement;

and a substrate drive for driving said substrate through a path of movement extending parallel to said linear array of nozzles in the printer head;

said processor controlling said printer head and electrical charger to print a pattern of test marks on a test strip extending along one side of said susbtrate parallel to said linear array of nozzles.

30. The apparatus according to claim 29, wherein said printer head drive continuously drives said printer head tranversely across said substrate, and said substrate drive drives said substrate in steps parallel to said linear array of nozzles in the printer head.

31. The apparatus according to claim 30, wherein said apparatus is a multi-color printer and includes a plurality of monochrome printer heads of different colors assembled together in a linear array extending parallel to said linear array of nozzles.

* * * * *